United States Patent [19]

Fréchin

[11] 4,079,962

[45] Mar. 21, 1978

[54] SELF RESTORING SKI BINDING HAVING SINGLE TENSIONING MEANS

[75] Inventor: Jean-Paul Fréchin, Chamonix, France

[73] Assignee: The Garcia Corporation, Teaneck, N.J.

[21] Appl. No.: 772,822

[22] Filed: Feb. 28, 1977

Related U.S. Application Data

[62] Division of Ser. No. 584,403, Jun. 6, 1975, Pat. No. 4,026,577.

[30] Foreign Application Priority Data

Jun. 14, 1974 France ..... 74 20825

[51] Int. Cl.[2] ..... A63C 9/08

[52] U.S. Cl. ..... 280/613; 280/637

[58] Field of Search ..... 280/637, 618, 613

[56] References Cited

U.S. PATENT DOCUMENTS

| | | | |
|---|---|---|---|
| 3,822,070 | 7/1974 | Salomon | 280/637 |
| 3,871,674 | 3/1975 | Bunn, Jr. | 280/637 |
| 3,893,682 | 7/1975 | Weinstein et al. | 280/637 |
| 3,924,866 | 12/1975 | Schweizer | 280/637 |
| 3,936,066 | 2/1976 | Witting | 280/637 |
| 4,026,576 | 5/1977 | Fréchin | 280/637 X |
| 4,026,577 | 5/1977 | Fréchin | 280/637 X |

*Primary Examiner*—Joseph F. Peters, Jr.
*Assistant Examiner*—Milton L. Smith
*Attorney, Agent, or Firm*—Fitzpatrick, Cella, Harper & Scinto

[57] ABSTRACT

A ski binding comprises a sole plate fixable under a boot sole, each end of the sole plate being held on a ski by a flexible cable under the action of a single tensioning device lodged in the sole plate. The cable passes about pulleys of said device, at least one of the pulleys being movable against the action of spring means to allow separation of the sole plate from the ski by withdrawal of cable.

11 Claims, 28 Drawing Figures

SELF RESTORING SKI BINDING HAVING SINGLE TENSIONING MEANS

This is a division of application Ser. No. 584,403, filed June 6, 1975 and now U.S. Pat. No. 4,026,577 issued May 31, 1977.

The invention relates to ski bindings, in particular bindings of the type comprising a sole plate fixable to a ski boot sole, in which each end of the sole plate is held against a ski by a flexible connection or cable permanently tensioned by elastic means.

In a known binding of this type, sold under the Trademark "Burt", each cable is tensioned by a separate spiral spring winder having an independent setting device. Such bindings are thus complex and have a large number of component parts. Also, the two springs cannot be adjusted simultaneously.

An object of the invention is to provide a binding of the stated type of simpler construction and lighter than the known ones. A further object is to simplify setting and enable simultaneous regulation of the release effort for each end of the sole plate, by arranging for a constant ratio between the release efforts for the two ends. A subsidiary object is to provide embodiments of the binding for which the retaining effort is such that after a certain predetermined force required for release, the retaining effort drops abruptly to allow rapid separation of the sole plate from the ski, this effort however being sufficient to automatically bring the ski firmly back under the sole plate when the force that produced separation ceases.

A security ski binding according to the invention comprises a single cable tensioning device comprising at least one movable element, two cable-tensioning parts cooperating with at least one flexible cable, at least one of said cable-tensioning parts being kinematically connected to a said movable element, and means for elastically biasing said at least one movable element to hold said at least one cable under tension.

In the case where there are two separate flexible cables for holding respective ends of the sole plate, an end of each cable is attached to the respective cable tensioning part, which may be rotatably mounted. In the case of a single cable, a part of the cable is wound about the two cable tensioning parts which may be pulleys or other rotatably mounted parts.

It is of course understood that the terms cable and flexible connection as used herein are meant to include all suitable flexible strands, cords, wires and other substantially non-extensible flexible elongate members.

In certain embodiments, the movable element is a rotatably mounted support on which the two cable tensioning pulleys or parts are disposed in substantially diametrically opposed positions.

In other embodiments, the two cable tensioning pulleys or parts are slidably mounted towards one another along a guide against the action of the biasing means which urge a profile of said movable element against them or against an intermediate element.

Other embodiments have a movable element formed by a rotatably mounted support having two guides disposed substantially radially to and in diametrically opposite positions about its axis of rotation, each cable tensioning pulley or part being movably mounted along one of these guides towards the other pulley or part against the action of the biasing means, formed by a spiral spring. Each of the two pulleys or parts bears against a respective cam profile of a fixed cam.

In other embodiments, one of the cable tensioning pulleys or parts is fixed, and the other is movably mounted along a guide towards the fixed pulley or part, against the action of the biasing means which holds the movable pulley or part, or an intermediate piece connected therewith, in contact with a profiled member.

The accompanying drawings show, by way of example, several embodiments of the invention. In the drawings.

Figure 1:
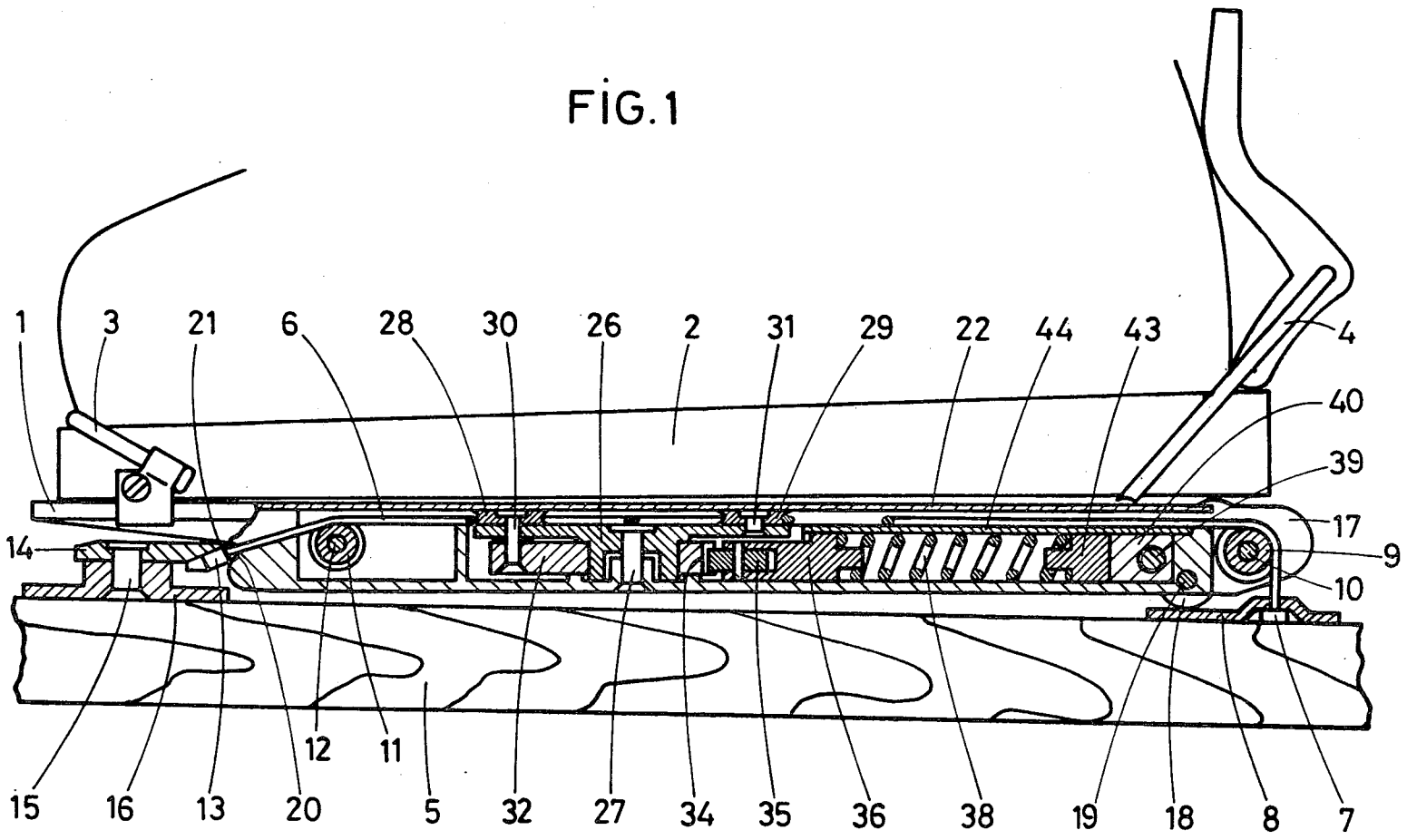
FIG. 1 is a longitudinal cross-section, taken along line I—I of FIG. 2, of a first embodiment of binding mounted on a ski, and holding a boot in place.
Figure 2:
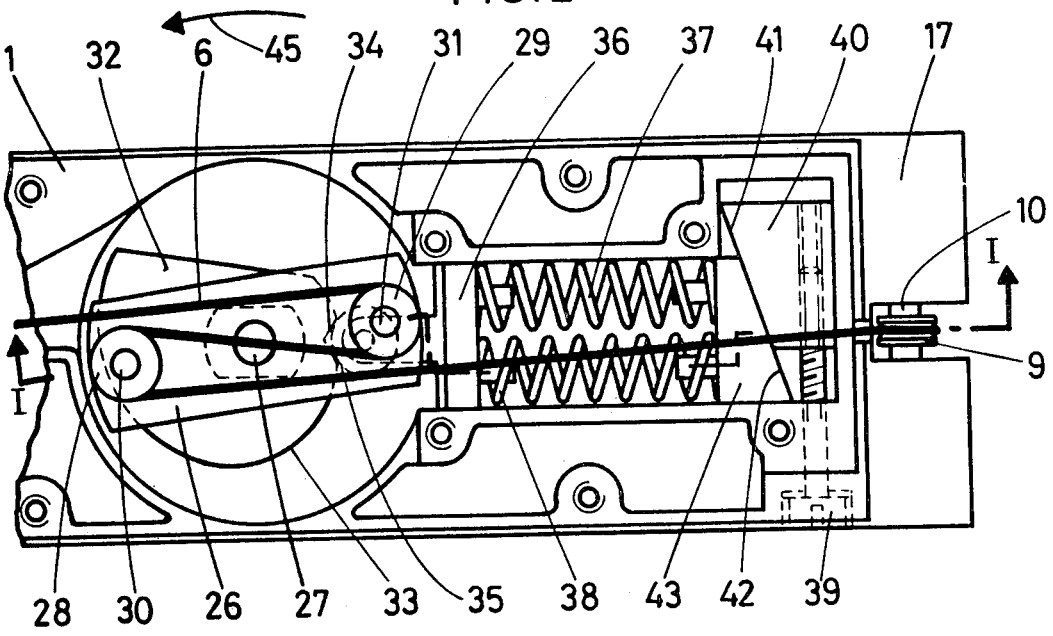
FIGS. 2 and 3 are top plan views of part of the binding of FIG. 1, shown with the cover plate removed, and respectively in a retaining and a release position.
Figure 3:
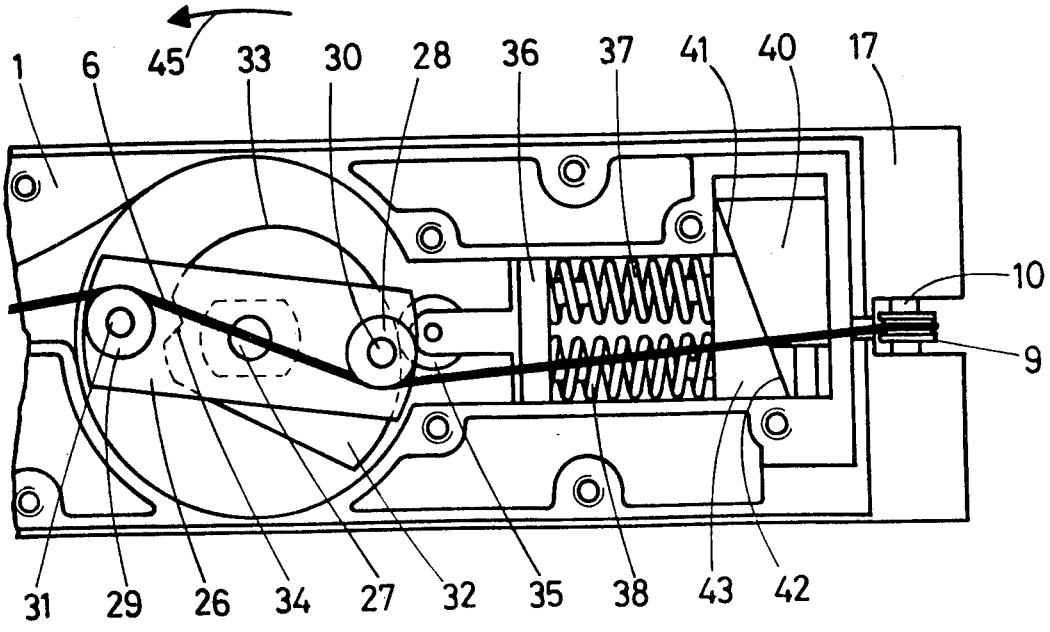

The first embodiment shown in FIGS. 1 to 3 comprises a hollow sole-plate 1 able to be secured under a boot sole 2 by a toe retaining member 3 and a heel retaining member 4. A single flexible cable 6 permanently tensioned by a single tensioning device which will be described later constantly tends to hold both ends of plate 1 down against a ski 5. The rear end 7 of cable 6 is fixed to ski 5 by a plate 8 screwed on the ski. From this end, cable 6 passes over a pulley 9 rotatably mounted on a shaft 10 fixed in a cut-out in plate 1, then cooperates with the single tensioning device, passes over a second pulley 11 rotatably mounted on a shaft 12 fixed in plate 1, and is finally secured by its front end 13 to a turning element 14 supported by a shaft 15 held on ski 5 by a securing plate 16. The rear part 17 of plate 1 includes downwardly-projecting rollers 18 pivoted at 19, these rollers bearing on plate 8 when the binding is "closed". The front part of plate 1 has a profiled part 20 of complementary profile to and cooperating with the edge 21 of element 14, to hold plate 1 on ski 5 when the binding is closed. A cover 22 closes the housing in plate 1 in which the single tensioning device is placed.

When the boot exerts on the front of plate 1 a predetermined minimum upwardly-directed or transverse force, the plate 1 moves slightly rearwardly, by rolling on rollers 18, and its profiled part 20 disengages from the edge 21 of element 14. The single tensioning device then releases a given length of cable 6 to allow the boot and plate 1 to separate from the ski, the ski automatically returning to its initial position applied under plate 1 when said upward or transverse force on the boot ceases.

When the boot exerts on the rear of plate 1 a minimum predetermined upwardly-directed or transverse force, plate 1 lifts up (and/or pivots about 15) relative to the ski, the single tensioning device releasing a certain length of cable 6 so that the boot and plate 1 may separate from ski 5. The ski automatically returns to its initial position applied under plate 1 when said upward or transverse force on the boot ceases.

The above description applies to all of the described embodiments.

In the first embodiment, FIGS. 1 to 3, the tensioning device includes a support 26 rotatably mounted on a shaft 27 fixed on plate 1. Two pulleys 28,29 are rotatably mounted about respective shafts 30,31 at opposite ends of support 26 in diametrically opposed positions about shaft 27. A cam 32 secured for rotation with support 26 and having a V-notch 34 and a cam surface 33, constantly bears against a roller 35 rotatably mounted on a piston 36 permanently urged by two compression springs 37 and 38. The radius of surface 33 progressively increases from notch 34, which engages with roller 35 in the closed or rest position of the binding, up to the point of surface 33 which engages roller 35 in the release position of the binding (FIG. 3). The pressure of springs 37,38 is adjustable by means of a transverse screw 39 the rotation of which moves a wedge-shaped nut 40 along the axial direction of the screw. An inclined face 41 of nut 40 cooperates with a corresponding inclined face 42 of a wedge 43 to move it perpendicular to nut 40, the wedge 43 serving as a support for the ends of springs 37,38. A cover 44 (removed from FIGS. 2 and 3) is placed over springs 37,38 and their adjusting device. Cable 6 is wound about pulleys 28,29 of the tensioning device as shown in FIGS. 2 and 3.

When a force on the boot tends to separate plate 1 from ski 5, the roller 35 engaging in notch 34 firstly opposes rotation of support 26, and hence a withdrawal of cable 6 which would permit plate 1 to move away from ski 5. When the force exceeds a predetermined minimum value, roller 35 is pushed back by an edge of notch 34 and the support 26 is rotated in direction 45 against the action of springs 37 and 38 which urge roller 35 against cam profile 33. The various elements thus move to the position of FIG. 3 in which the extra available length of cable 6 allows plate 1 to remain away from ski 5.

During the initial part of rotation of support 26 and cam 32, the angular displacement of pulleys 28,29 tends to reduce the tension of cable 6, whereas the increase in the effective radius of cam surface 33 tends to increase the tension; by choice of the cam surface 33 it is thus possible to obtain a curve of the retaining force which, after having passed a maximum value while roller 35 is pushed back by the face of notch 34, abruptly drops and then increases slightly, remains constant, or decreases slightly. The binding returns to the rest position of FIG. 2 as soon as the force exerted on the boot ceases. Rotation of screw 29 enables setting of the minimum force above which the sole plate 1 is freed from ski 5.

Figure 4:
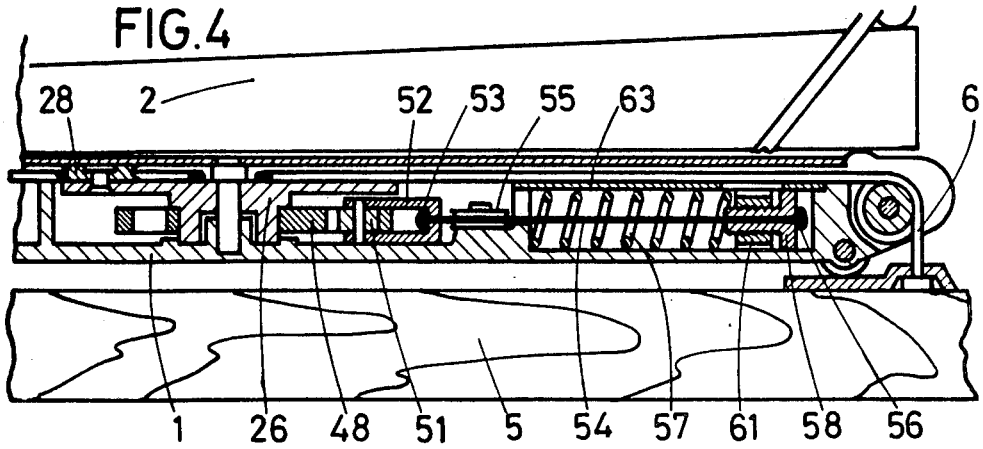
FIG. 4 is a cross-section, taken along line IV—IV of FIG. 5, of part of a second embodiment of binding mounted on a ski and holding a boot in place.
Figure 5:
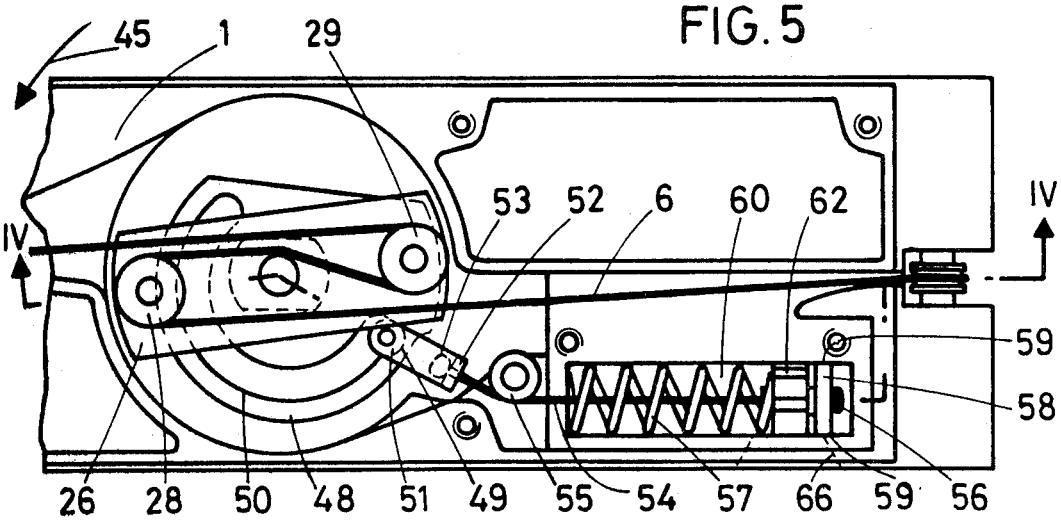
FIGS. 5 and 6 are views corresponding to FIGS. 2 and 3 of the second embodiment.
Figure 6:
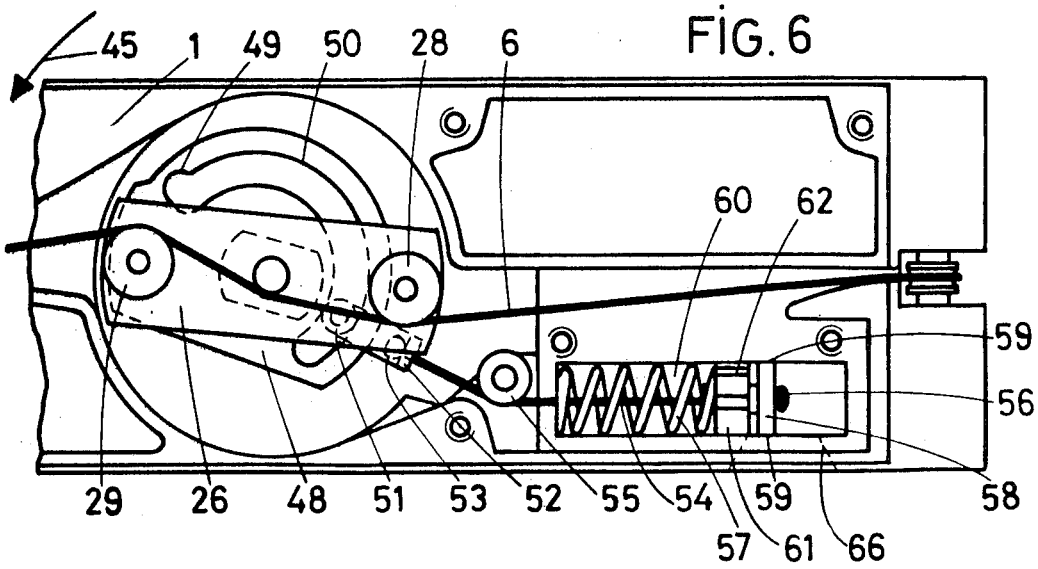

The pressure actuated roller 35 may, as shown in FIGS. 4 to 6, be replaced by a similar system operating by tension. In this second embodiment, the tensioning device is formed, as in the first embodiment, by a rotatable support 26 carrying two pulleys 28,29. A cam 48 is keyed for rotation with support 26, the cam having a profile including a notch 49 extending by a groove with an eccentric curved surface 50 the operative radius of which decreases as support 26 passes from the rest position (FIG. 5) to the release position (FIG. 6). A roller 51 constantly applied against this profile is rotatably mounted on a yoke 52 in which an enlarged end 53 of a cable 54 is held. Cable 53 is guided by a pulley 55 and its second end 56 held by a spring 57 by means of a device for adjusting the pressure of this spring. This device includes a screw 58 to which end 56 is hooked, and which is slidably but not rotatably mounted in a housing 60 by means of flats 59. Screw 59 carries a nut 61 against which the end of spring 57 bears. Nut 61 has notches 62 enabling it to be rotated to adjust the pressure of spring 57. A window 66 is provided in the lateral face of plate 1 to allow access for this adjustment, and a cover 63 (removed from FIGS. 5 and 6) is fitted on housing 60. All of the other elements are identical to those of the previous embodiment.

When a force on boot 2 tends to separate plate 1 from ski 5, roller 51 initially in the rest position (FIG. 5) engaging in notch 49 only allows a very slight rotation of support 26, and hence a slight effective extension of cable 6. When the force on the boot reaches a preset minimum value, roller 51 disengages from notch 49 and support 26 is rotated in direction 45 against the action of spring 57 which pulls roller 51 against surface 50 of cam 48. The various parts thus move to the position of FIG. 6, in which the cable 6 is fully wound out to allow separation of plate 1 from ski 5.

During the initial part of rotation of support 26 and cam 48, the angular displacement of pulleys 28 and 29 tends to reduce the tension of cable 6 whereas reduction of the effective radius of surface 50 tends to simultaneously increase the tension of cable 6, by a lesser degree. The surface 50 can thus be arranged to provide a curve of the retaining force which, after having passed through a maximum value while roller 51 is engaged in notch 49, abruptly drops and then decreases slightly.

Figure 7:
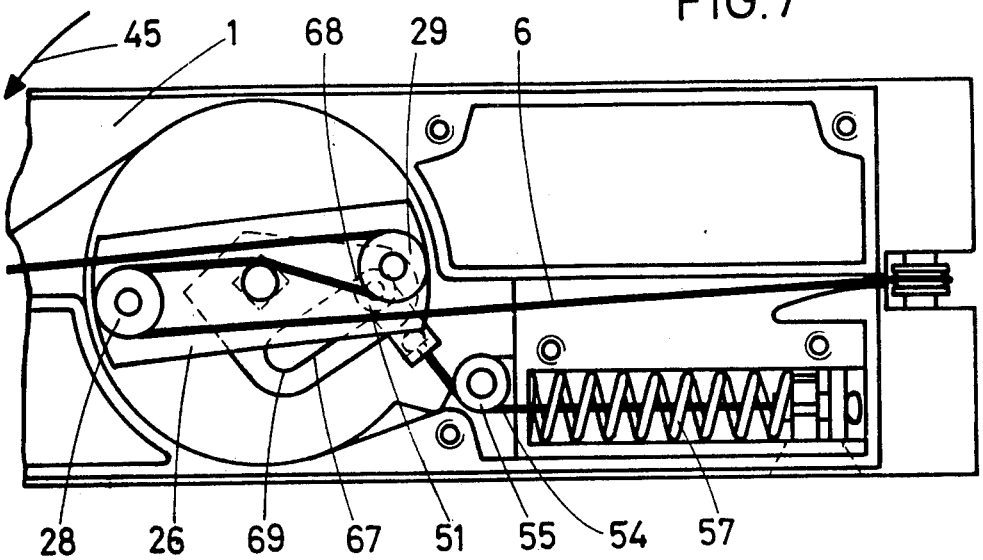
FIGS. 7 and 8 are similar views of a third embodiment.
Figure 8:
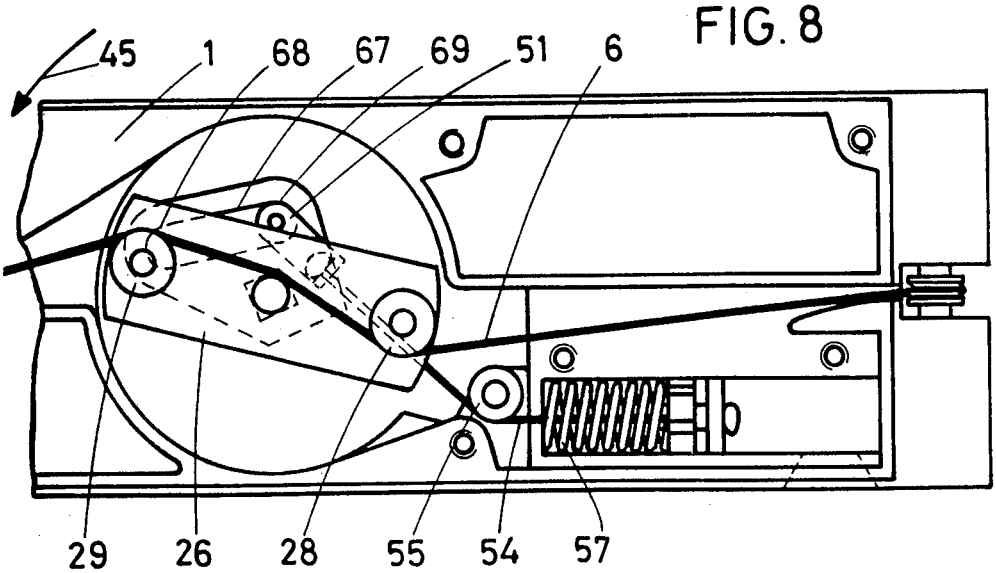
Figure 9:
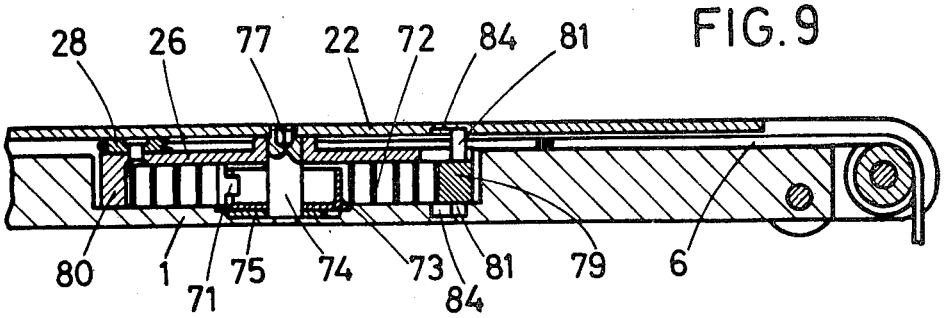
FIG. 9 is a cross-section taken along line IX—IX of FIG. 10, of a fourth embodiment of binding.

In the third embodiment, FIGS. 7 and 8, the tensioning device differs from that of the second embodiment solely in that cam 48 with notch 49 and surface 50 is replaced by a rectilinear guide slot 67 of which one end 68 is further away from the axis of rotation of support 26 than its other end 69. The previously described roller 51 is lodged in this guide slot along which it can move. All of the other elements are the same as for the second embodiment.

When a force on boot 2 tends to separate plate 1 from ski 6, the roller 51 which, in the initial rest position (FIG. 7) is in contact with end 68 of slot 67, exerts an opposing force which increases rapidly up to the moment when the support 26 having rotated by a certain amount in direction 45, the longitudinal axis of slot 67 is perpendicular to an axis through the shaft of roller 51 and the point of contact of cable 54 on pulley 55. From this moment, roller 51 starts to roll along slot 67 until after a further rotation of support 26, it abuts against end 69. The roller 51 then remains in this position during the remainder of the rotation of support 26 which finally arrives in the position of FIG. 8 in which the fully wound out cable 6 allows separation of plate 1 from the ski.

With this arrangement, the curve of the retaining force is substantially the same as for the second embodiment.

The tension actuated roller 51 of the third embodiment, forming a piece for the transmission of the spring force, could be replaced by a pressure urged piston, cooperating with an appropriately positioned slot or other guide.

Figure 10:
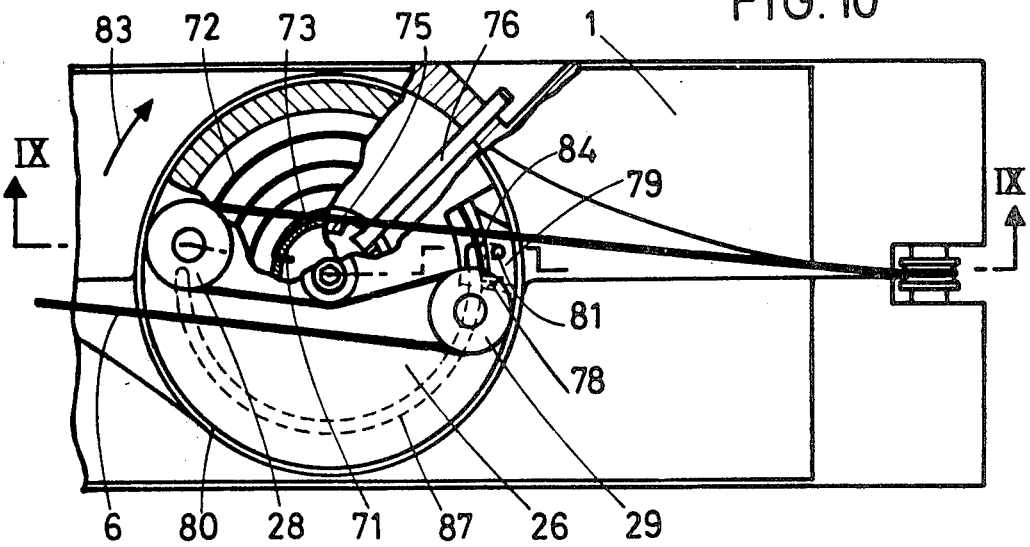
FIGS. 10 and 11 are plan views corresponding to FIGS. 2 and 3 of the fourth embodiment, but with parts cut away and shown in cross-section.
Figure 11:
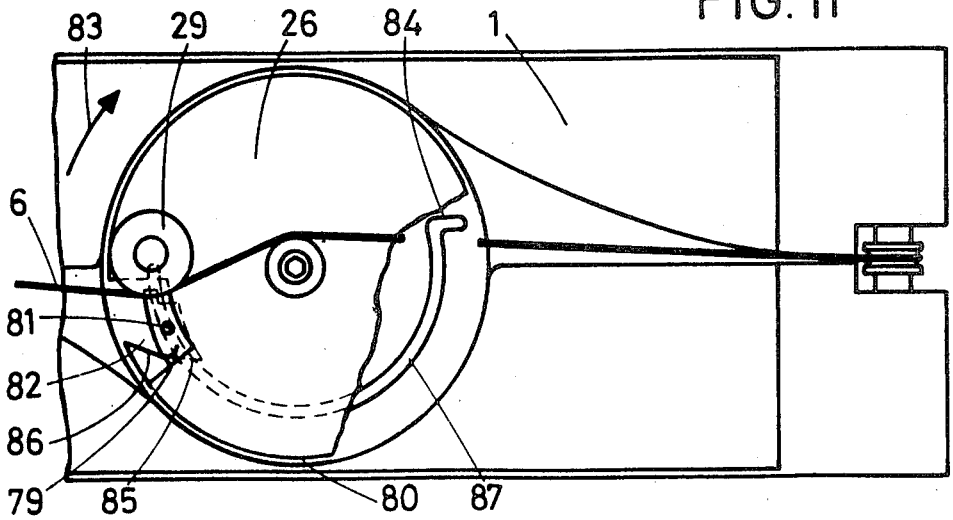

In the fourth embodiment, FIGS. 9 to 15, the tensioning device is, as before, formed by a rotatable support carrying two pulleys 28,29. However, support 26 is biased by a spiral spring 72 having one end attached to a rim 73 keyed on a rotatable shaft 74 on which the support 26 is freely rotatably mounted. A toothed part 75 fixed to rim 73 cooperates with a sliding piece 76 to hold the rim 73 angularly fixed, and hence set the degree of winding of spring 72. By temporarily disengaging piece 76 from the toothed part 75, the degree of winding of spring 72 can be set by turning shaft 74 by engaging an Allen key in a polygonal recess 77 (FIG. 9) in the accessible upper end of shaft 74. The outer end 78 of spring 72 is hooked in a piece 79 mounted on support 26 for a limited radial and circumferential movement in an opening 82 in the periphery of support 26 and in a cylindrical barrel 80 integral with support 26, this barrel 80 being concentric to shaft 74 and housing spring 72. Piece 79 carries a protruding pin 81 which, in the rest position is outwardly pushed by spring 72 in like groves 84 disposed in the bottom of plate 1 and in cover 22 substantially radial to barrel 80. Piece 79 and barrel 80 have cooperating facing ramps 85,86 respectively, arranged to radially inwardly move piece 79 and its pin 81 when support 26 is rotated in direction 83 against the action of spring 72, while piece 79 is angularly locked by the engagement of pins 81 in grooves 84. At their innermost ends, grooves 84 are extended by arcuate grooves 87 concentric to shaft 74 and extending over about a semi-circle. Cable 6 is wound about pulleys 28 and 29 as shown in FIGS. 10 and 11.

Figure 12:
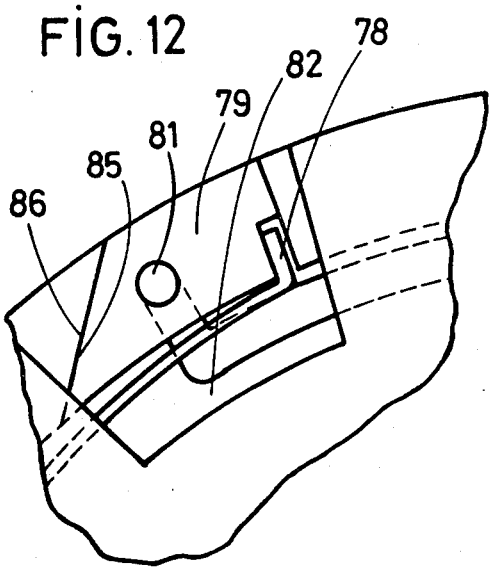
FIGS. 12 to 15 are partial views showing different phases of operation of the fourth embodiment.
Figure 13:
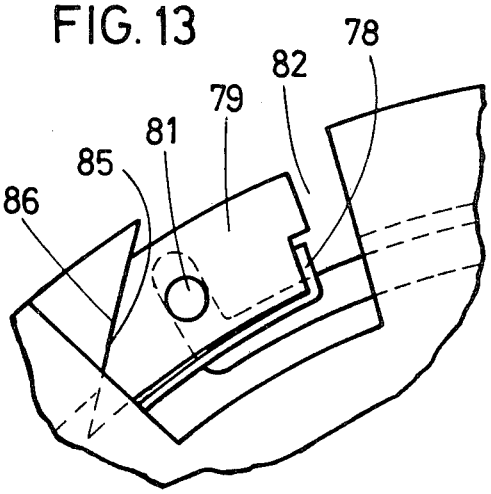

When a force on the boot tends to separate plate 1 from ski 5, support 26 and its integral barrel 80 are rotatably driven in direction 83 from the rest position shown in FIGS. 10 and 12. In a first phase, ramp 86 acting against ramp 85 inwardly displaces piece 79 radially relative to barrel 80, successively to the positions of FIGS. 13 and 14, until pin 81 engages the inner end of grooves 84, adjacent grooves 87. Piece 79 and pin 81 are then pushed by barrel 80, against the action of spring 72, in direction 83 along grooves 87, as shown in FIG. 15. After about half a turn, support 26 arrives in the position of FIG. 11 in which cable 6 is fully wound out and allows plate 1 to be separated from the ski.

Figure 14:
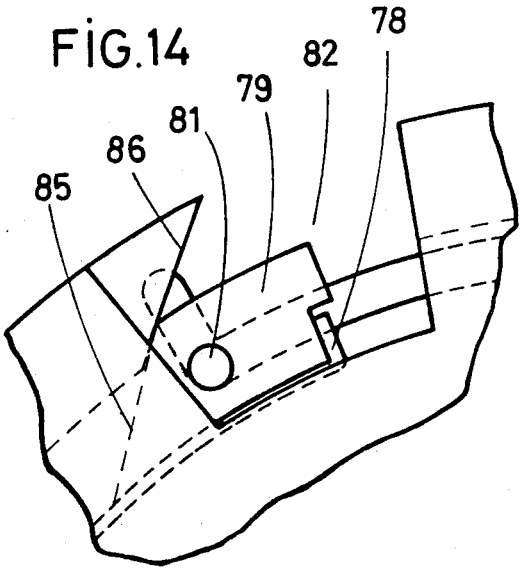
Figure 15:
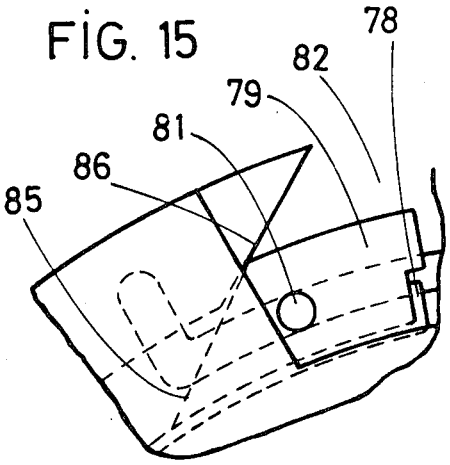

At the beginning of rotation of support 26 and barrel 80 (FIGS. 13 and 14), the angular displacement of pulleys 28 and 29 tends to slightly reduce the tension of cable 6, whereas simultaneously the resistance provided by ramp 85 tends to greatly increase the tension of cable 6 up to the moment when pin 81 arrives in the position of FIG. 14 and the support 26 is driven against the action of spring 72. Selection of the inclination of ramps 85,86 hence enables the obtention of various curves of the retaining force which after having passed a maximum value while ramp 85 slides on ramp 86, abruptly drops and then remains substantially constant.

Figure 16:
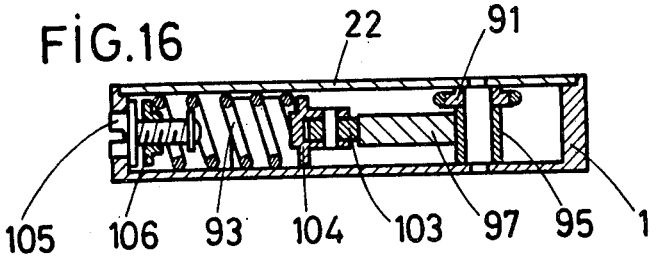
FIG. 16 is a transverse cross-section along line XVI—XVI of FIG. 17, of a fifth embodiment of binding.
Figure 17:
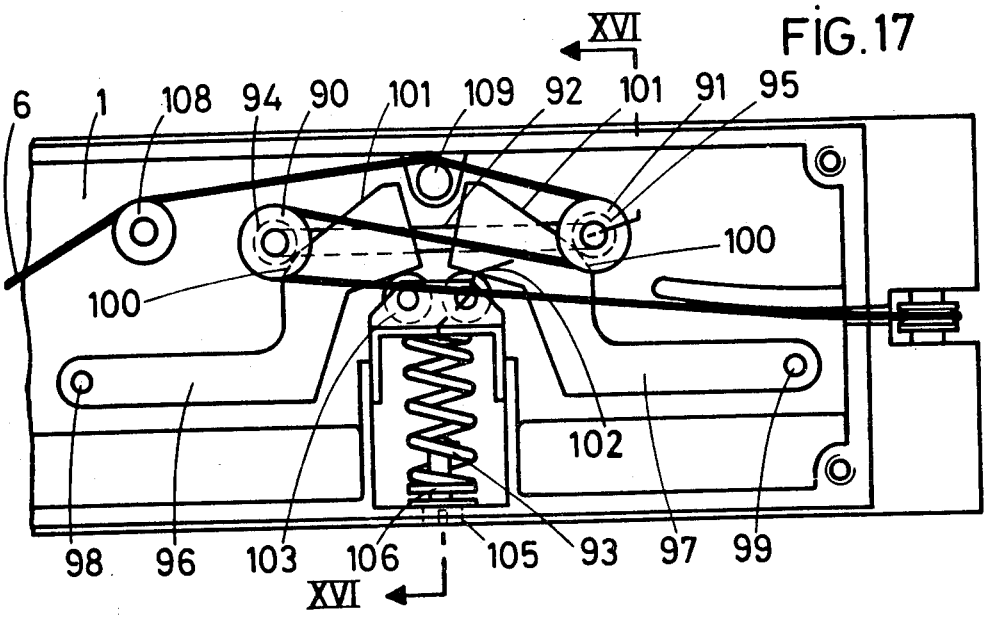
FIGS. 17 and 18 are views corresponding to FIGS. 2 and 3 of the fifth embodiment.
Figure 18:
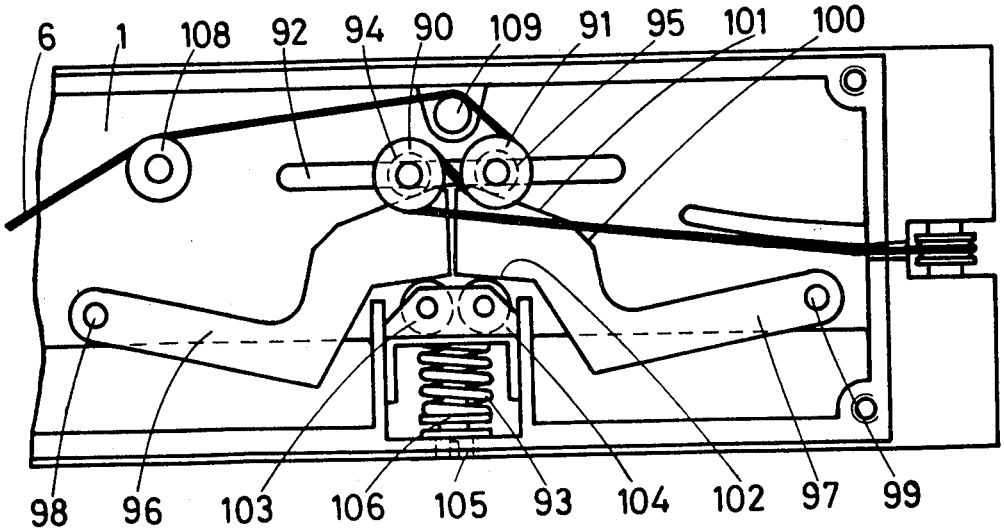

The tensioning device of the fifth embodiment, shown in FIGS. 16 to 18, comprises two cable-tensioning pulleys 90,91 disposed in facing guide slots 92 along which they can be moved together against the action of a compression spring 93. This spring holds in contact with rollers 94,95 respectively integral with rollers 90,91, profiled surfaces of two levers 96,97 which are disposed symmetrically to the axis of spring 93 and are respectively pivoted to plate 1 by pins 98,99. The profiled surface of each lever has two ramps 100,101 of different inclination. Each lever also has a bearing face 102 substantially opposite to ramps 100 and 101. Each of these faces 102 bears against a roller 103 pivoted on a piston-piece 104 urged by spring 93. A setting screw 105 carries a nut 106 movable axially by screw 105 to set the pressure of spring 93. Cable 6 passes pulleys 90,91 as shown in FIGS. 17 and 18, and is further guided by guide pulleys 108,109.

When a force on the boot tends to separate plate 1 from ski 5, cable 6 tends to move the pulleys 90,91 together from the rest position of FIG. 17 in which rollers 94,95 contact ramps 100 which are relatively greatly inclined to the axis of slots 92. Ramps 100 initially strongly oppose pulling together of rollers 94,95 and hence the unwinding of cable 6 to allow separation of plate 1 from the ski. When said force reaches a preset minimum value, rollers 94 and 95 push back ramps 100 and come to roll on ramps 101 which are inclined to the axis of slots 92 by a lesser amount, until they finally reach the position of FIG. 18, in which cable 6 is fully wound out.

The inclinations of ramps 100,101 enable the obtention of a curve of the retaining force which, after passing a maximum value corresponding to the period when each roller 94,95 acts against a ramp 100, abruptly drops and then increases slightly.

In a variation (not shown) of the fifth embodiment, levers 96 and 97 and rollers 103 of piston-piece 104 are dispensed with, the ramps 100,101 being replaced by corresponding ramps on piston-piece 104, these ramps cooperating directly with rollers 94 and 95. All of the other elements are the same as for the fifth embodiment, and operation is similar.

Figure 19:
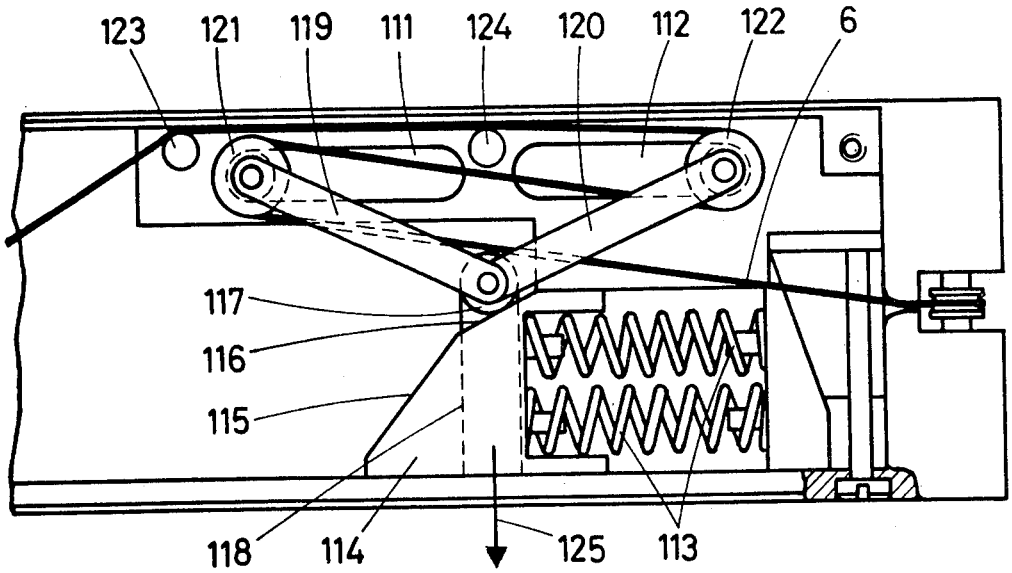
FIG. 19 is a view corresponding to FIG. 2 of a sixth embodiment.
Figure 20:
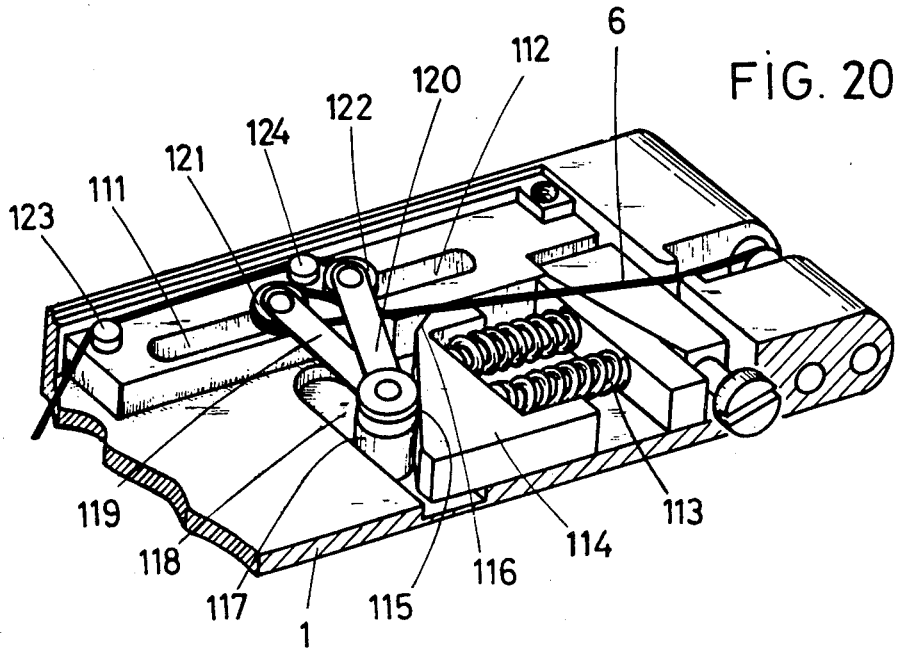
FIG. 20 is a partial perspective view of the sixth embodiment of binding in release position.

In the sixth embodiment, shown in FIGS. 19 and 20, the tensioning device comprises two cable-tensioning pulleys 121,122 guided in respective guide grooves 111,112. The pulleys 121,122 are carried at the ends of like arms 119,120 articulated together to form a toggle and carrying a roller 117 pivoted about their axis of articulation. This roller 117, disposed concentric to the two pulleys 121,122, is able to move in a guide groove 118 perpendicular to grooves 111,112, and against the biasing action of two compression springs, 113, to bring pulleys 121,122 together. Springs 113 urge a wedge-shaped piece 114 having ramps 115,116 against which the roller 117 bears. Ramp 116 is more inclined to the axis of groove 118 than is ramp 115. The compression of spring 113 is adjustable by a wedge device identical to that described for the first embodiment. Cable 6 is wound about pulleys 121,122 as shown in FIGS. 19 and 20, and is additionally guided by pulleys 123,124.

When a force on the boot tends to separate plate 1 from the ski, cable 6 tends to move pulleys 121,122 together from the rest position of FIG. 19, by means of toggle levers 119,120 which tend to move roller 117 along direction 125 against ramp 116 of piece 114. Ramp 116 initially strongly opposes moving together of pulleys 121,122; then, when said force reaches a preset minimum value, roller 117 pushes ramp 116 and rolls on the lesser-inclined ramp 115 to finally reach the position of FIG. 20 in which cable 6 is fully wound out.

The curve of the retaining force is approximately the same as for the previous embodiment.

In a variation, not shown, of the sixth embodiment, guide groove 112 and transverse groove 118 are dispensed with; pulley 122 is fixed, and roller 117 thus moves angularly about this pulley 122, about an axis of rotation which may be distinct from that of pulley 122. All of the other elements of the binding are the same as for the sixth embodiment; operation is similar, the rectangular movement of roller 117 along direction 125 being replaced by an arcuate movement, for example about the axis of pulley 122.

Figure 21:
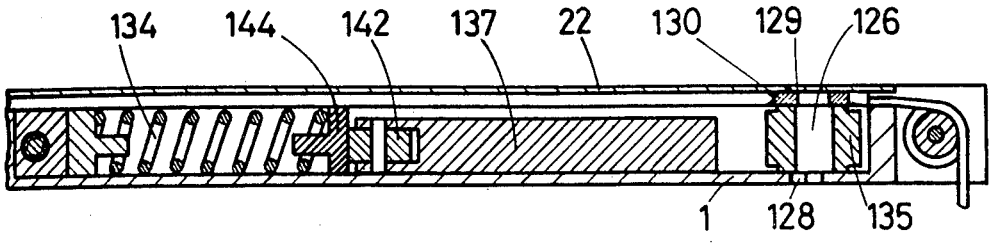
FIG. 21 is a partial cross-section taken along line XXI—XXI of FIG. 22 of a seventh embodiment.
Figure 22:
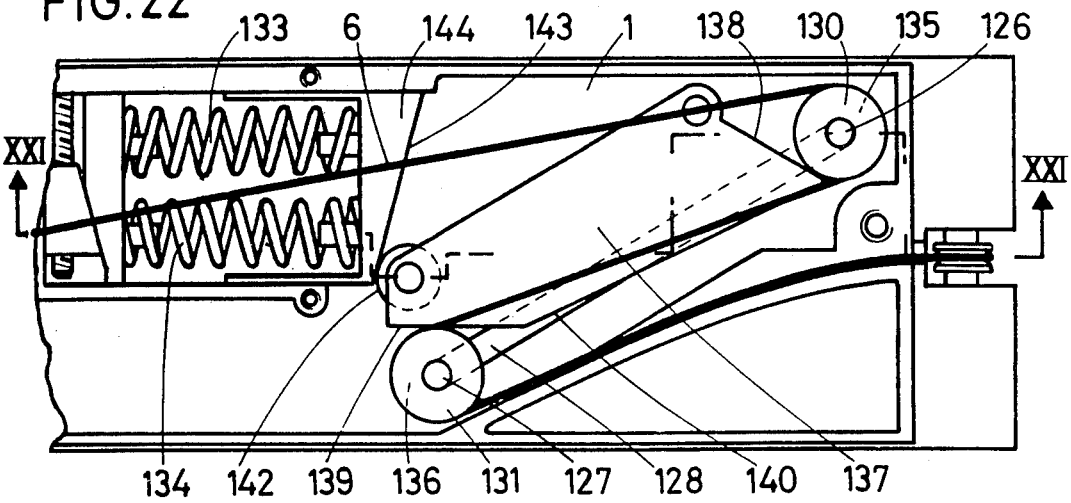
FIGS. 22 and 23 are views corresponding to FIGS. 1 and 2 of the seventh embodiment.
Figure 23:
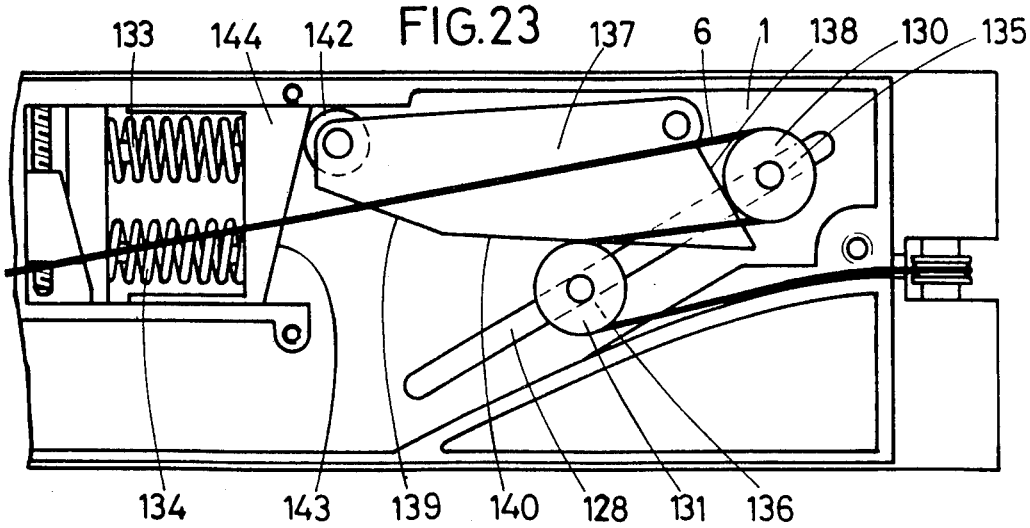

The seventh embodiment of binding, shown in FIGS. 21 to 23, has a tensioning device comprising pulleys 130,131 pivoted on respective pins 126,127 whose ends are slidably mounted in guide slots 128,129 respectively in the bottom of plate 1 and in cover 22. Pins 126,127 also carry rollers 135,136 respectively which, with pulleys 130,131 can move together along slots 128,129 against the biasing action of compression springs 133,134. These springs hold ramps on a pivoted member 137 against rollers 135,136. Member 137 has on one face a ramp 138 bearing against roller 135, and two ramps 139,140 one of which bears against roller 136. The other face of member 137 carries a pivoted bearing roller 142 acting against an inclined plane 143 of a wedge-like piston piece 144 urged by springs 133,134. The pressure of these springs is adjustable by a device identical to that of the first and sixth embodiments. Cable 6 passes about pulleys 130,131 as shown in FIGS. 22 and 23.

When a force on the boot tends to separate plate 1 from the ski, cable 6 tends to draw the pulleys 130,131 together from the rest position of FIG. 22. Rollers 135,136 each tend to roll along its respective bearing ramp 138,139 which firstly opposes this pulling together. When the force on the boot exceeds a preset minimum value, rollrs 135,136 push back their ramps and member 137 tips with roller 142 rolling on plane 143. The roller 136 rolls along ramp 139 and then ramp 140, which is less inclined than ramp 139 to the trajectory of rollers 135,136, until the position of FIG. 23 is reached, with cable 6 fully wound out.

The curve of the retaining force is similar to that of the fifth and sixth embodiments.

In a variation, not shown, of the seventh embodiment, roller 142 and piece 144 with inclined plane 143 are dispensed with, and springs 133,134 act directly on the second face of member 137. All of the other elements are the same as for the seventh embodiment, and operation is similar.

The slots 128,129 of the seventh embodiment and its described variation could be replaced by discrete pairs of slots or grooves for each roller; these pairs of grooves need not be aligned, nor parallel, nor rectilinear.

Figure 24:
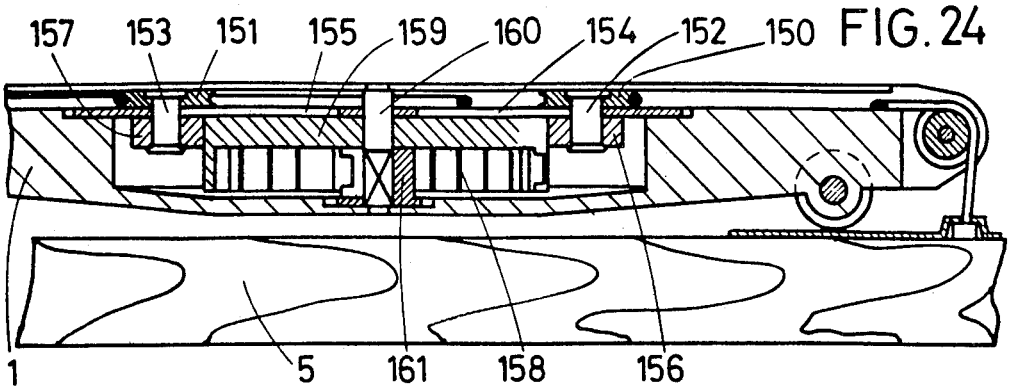
FIG. 24 is a partial cross-section taken along line XXIV—XXIV of FIG. 25, showing an eighth embodiment of binding mounted to a ski.
Figure 25:
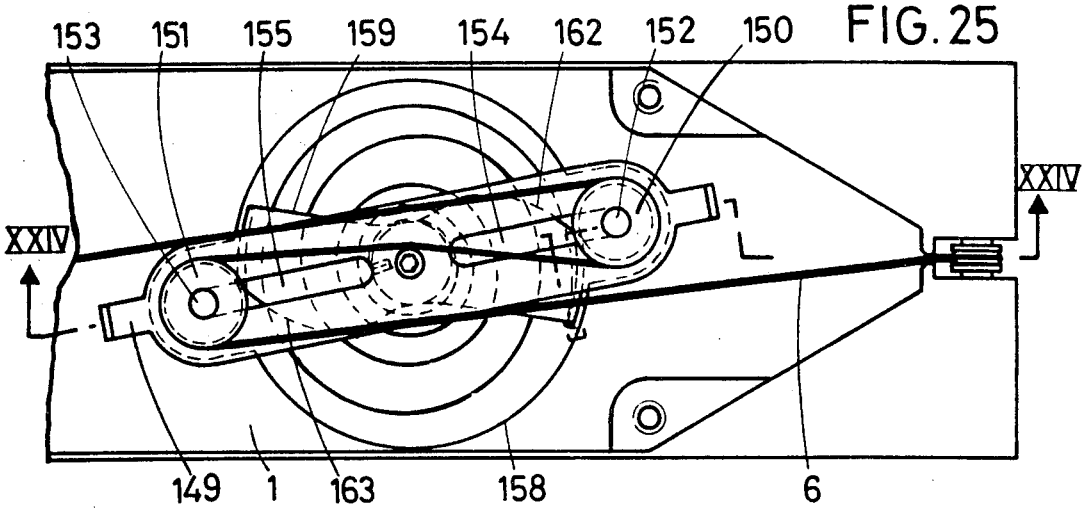
FIGS. 25 and 26 are views corresponding to FIGS. 1 and 2 of the eighth embodiment.
Figure 26:
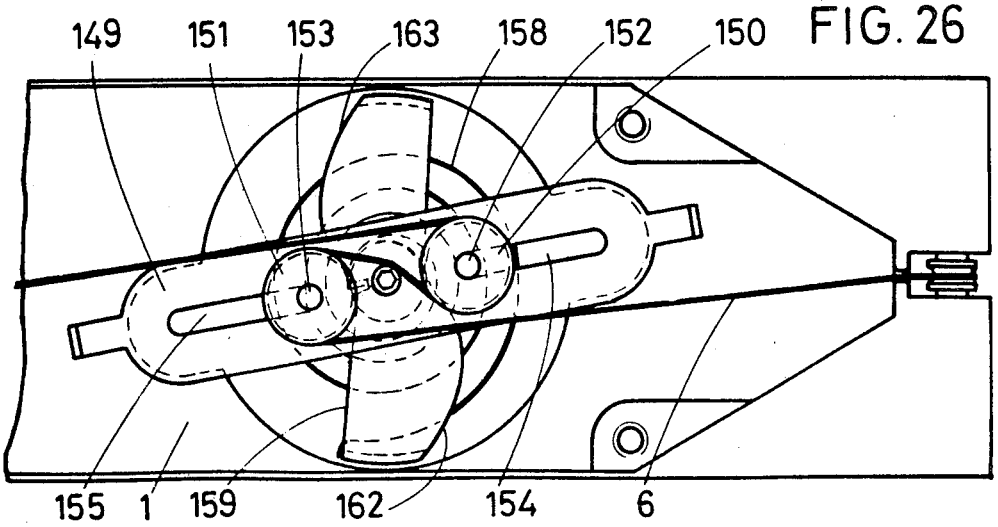

The tensioning device of the eighth embodiment, FIGS. 24 to 26, comprises pulleys 150,151 pivoted at one end of respective pins 152,153 A central part of each pin 152,153 is guided in a respective slot 154,155 in a plate 149 fixed to plate 1. The second end of each pin 152,153 carries a roller 156,157 respectively. These rollers are able to move together along slots 154,155 against the biasing action of a spiral spring 158 acting on a cam 159. This cam is rotatably mounted on plate 1 about a rotatable shaft 160 having a piece 161 keyed thereto. The inner end of spring 158 is attached to piece 161, and its outer end to cam 159. Facing rollers 162,163 respectively, cam 159 has two cam profiles 162,163, arranged so that when cam 159 passes from the rest position (FIG. 25) to the release position (FIG. 26), the operative part of profiles 162,163 against which rollers 156,157 act is of decreasing radius. The tension of spring 158 can be set by the same means as for the fourth embodiment. Cable 6 passes about pulleys 151,152 as shown in FIGS. 25 and 26.

When a force on the boot tends to separate plate 1 from the ski cable 6 tends to move pulleys 150,151 together from their rest position, FIG. 25. Rollers 156,157 tend to roll on ramps 162,163 of cam 159, which under the action of spring 158 initially oppose the pulling together of the rollers. When said force exceeds a preset minimum value, rollers 150,151 push their ramps 1 and cam 159 turns, winding up spring 158 to the position of FIG. 26 in which cable 6 is fully unwound.

In a variation, not shown, of the eighth embodiment, cam 159 is fixed to plate 1 and the plate 149, carrying pulleys 150,151, is rotatably mounted, the outer end of spring 158 beng connected to this plate 149. The slots 154,155 are thus radially and diametrically opposed about the shaft 160 serving as axis of rotation of plate 149. All of the other elements remain the same as in the eighth embodiment. Operation is similar, but rotation of cam 159 is replaced by rotation of plate 149 carrying the slidably mounted pulleys 150,151.

Figure 27:
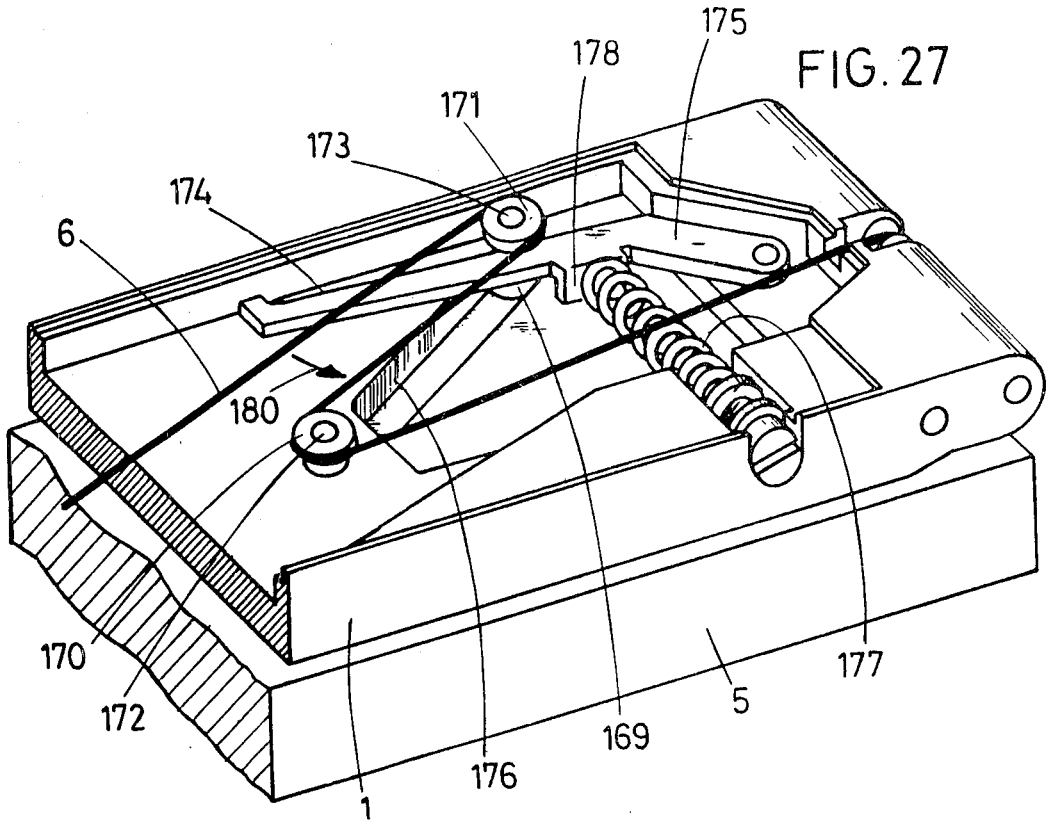
FIG. 27 is a partial perspective view of a ninth embodiment of binding, with the cover plate removed and in release position.
Figure 28:
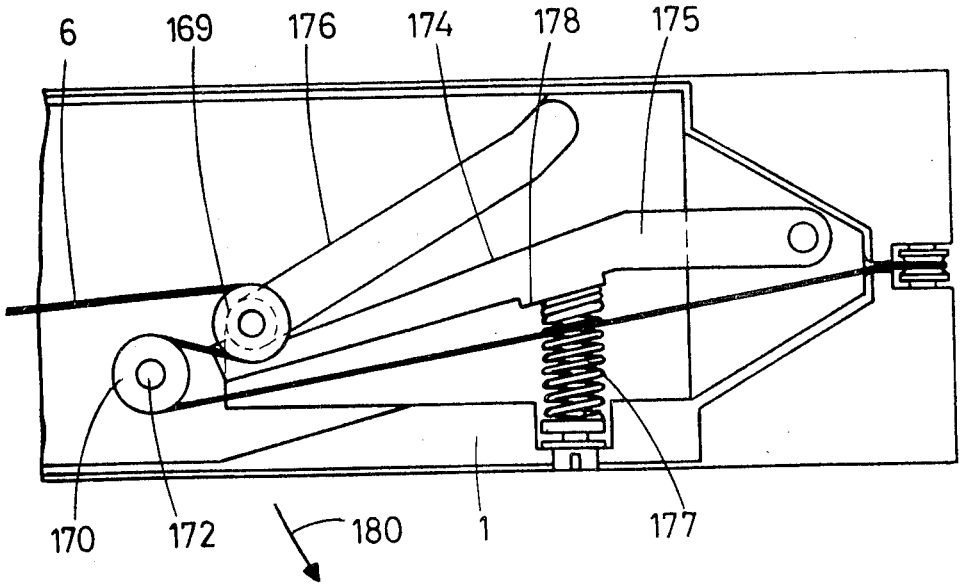
FIG. 28 is a view corresponding to FIG. 2 of the ninth embodiment.

The tensioning device of the ninth embodiment, shown in FIGS. 27 and 28, has a stationary pulley 170 pivoted on a pin 172 fixed in plate 1, and a movable pulley 171 pivoted on a pin 173 which also carries a roller 169 which can move along a guide groove 176, and bears against a surface 174 of a lever 175 pivoted on plate 1. A compression spring 177, adjustable by the means described for the fifth embodiment, acts against a face 178 of lever 175 opposite face 174, to bias lever 175 towards the rest position of FIG. 27. Cable 6 passes about pulleys 170,171 as shown in FIGS. 27 and 28.

When a force on the boot tends to separate plate 1 from the ski, cable 6 tends to move roller 169 along groove 176 away from its rest position. Lever 175 initially opposes this movement, then when said force exceeds a preset minimum value, roller 169 rolls along groove 176, pushing lever 175 in direction 180, the resistance provided by spring 177 reducing as the lever tips. Finally, the roller 169 pushes the position of FIG. 28 in which cable 6 is fully wound out. As soon as said force ceases, the binding moves back to the rest position.

In the case where the single cable passing about two pulleys or other rotatable or non rotatable bearing parts is replaced by two distinct cables, both of the cable tensioning parts cooperating with the cables must in principle be movable to enable both ends of the sole plate to be releasable.

Instead of being housed in the sole plate, the single tensioning device of the release mechanism could be housed in a casing fixed on the ski.

Also, a single cable could be wound about more than two rollers or other cable-tensioning parts.

What is claimed is:

1. In a releasable ski binding comprising a sole plate, means for releasably securing a ski boot to said sole plate, at least one flexible cable housed within said sole plate to extend from opposite ends thereof, the ends of said cable being secured to the surface of a ski to permit release of said sole plate from said ski upon application of a minimum release force and automatic return of said plate to said ski upon abatement of said force, an improved means for continuously tensioning said cable which comprises:

a pair of cable engaging elements mounted within said sole plate, at least one of said elements being movable between a first position wherein said elements are spaced from each other and the length of said cable is reduced and a second position wherein said elements are proximate to each other and the length of said cable is increased; and biasing means housed within said sole plate and arranged to continuously urge said at least one movable element towards said first position.

2. A binding according to claim 1, further including means defining a guide for said pair of cable engaging elements along which said elements can move towards one another against the action of said biasing means, and at least one movable element arranged between said biasing means and said cable engaging elements and having a profiled surface acting at least indirectly against each of said cable engaging elements.

3. A binding according to claim 2, wherein said at least one movable element is a pair of levers each having at least one ramp surface engaging a respective cable engaging element and an opposed face bearing upon a roller urged by said biasing means in a direction transverse to said guide.

4. A binding according to claim 2, wherein said at least one movable element comprises an inclined ramp bearing upon an intermediate roller guided to move transverse to said guide, and a toggle-joint articulated at said intermediate roller and connecting said roller to said cable engaging elements.

5. A binding according to claim 2, wherein said at least one movable element comprises a pivoted movable element having opposite first and second faces, said first face comprising at least one ramp for cooperation with each cable engaging element said biasing means acting on said second face of said movable element.

6. A binding according to claim 5, wherein said biasing means acts on said second face of said movable element by a push-piece arranged therebetween, said push-piece having an inclined face cooperating with a roller carried on said second face of said movable element.

7. A binding according to claim 2, wherein said at least one movable element is a cam rotatably mounted about an axis perpendicular to said guide and said biasing means comprises a spiral spring, said cam, having two diametric faces each bearing against a respective one of said cable engaging elements said cam being rotatable against the action of said spiral spring from said first position to said second position, each cam profile having an operative radius about said axis which decreases as said cam moves from said first to said second position.

8. A binding according to claim 1 further including, a rotatable support mounted within said sole plate for rotation about an axis perpendicular to the plane of said sole plate, said support defining two guides disposed substantially radially to and diametrally opposed about said axis, said cable engaging elements being movably mounted along said guides towards one another into contact with opposite cam profiles of a fixed cam, said biasing means comprising a spiral spring arranged to urge said support to tend to separate said cable tensioning parts, said support being movable against the action of said spiral spring from said first position to said second position said cam profiles each having an operative radius about said axis which decreases as said support moves from said first to said second position.

9. A binding according to claim 1, wherein one of said cable engaging elements is fixed and said second cable engaging element is movable along guide means towards and away from said first element, and said biasing means is constructed and arranged to continuously urge said second element away from said first element.

10. A binding according to claim 9, which further includes a lever pivoted about a fixed axis, said lever being urged by said biasing means to move said movable element away from said fixed element.

11. A binding according to claim 1, in which said guide means includes a profile against which said second element is urged by said lever.

* * * * *